US006957887B2

(12) United States Patent
Bruhn

(10) Patent No.: US 6,957,887 B2
(45) **Date of Patent: *Oct. 25, 2005**

(54) VACUUM HOLDDOWN

(75) Inventor: Victor Bruhn, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 81 days.

This patent is subject to a terminal disclaimer.

(21) Appl. No.: 10/676,344

(22) Filed: Sep. 30, 2003

(65) Prior Publication Data

US 2004/0066445 A1 Apr. 8, 2004

Related U.S. Application Data

(63) Continuation of application No. 10/264,974, filed on Oct. 3, 2002, now Pat. No. 6,679,602.

(51) Int. Cl.[7] ..... B41J 2/01

(52) U.S. Cl. ..... 347/104; 347/101; 347/102

(58) Field of Search ..... 347/102, 104, 347/164, 197, 215, 264, 101, 105; 346/134, 136; 400/635, 648; 271/194

(56) References Cited

U.S. PATENT DOCUMENTS

| | | | |
|---|---|---|---|
| 6,172,741 | B1 | 1/2001 | Wotton et al. |
| 6,234,472 | B1 | 5/2001 | Juan |
| 6,254,090 | B1 | 7/2001 | Rhodes et al. |
| 6,270,074 | B1 | 8/2001 | Rasmussen et al. |

*Primary Examiner*—Manish S. Shah

(57) ABSTRACT

A vacuum holddown for a hard copy device includes a platen having plural vacuum zones arranged in a side-by-side array across the platen. Each vacuum zone has a closed end and an open end and is coupled to a vacuum source. Each vacuum zone defines a recess in the upper surface of the platen that is fluidly coupled to the vacuum source through a port. The back walls and side walls of each vacuum zone are coplanar with the upper surface of the platen. A step may be positioned in the vacuum zones to define an open vacuum zone having multiple depths.

20 Claims, 4 Drawing Sheets

VACUUM HOLDDOWN

CROSS REFERENCE TO RELATED APPLICATION(S)

This is a continuation of application Ser. No. 10/264,974, filed Oct. 3, 2002, now U.S. Pat. No. 6,679,602, which is hereby incorporated by reference herein.

TECHNICAL FIELD

This invention relates to vacuum holddown apparatus for stabilizing media, and their method of operation in hard copy devices.

BACKGROUND OF THE INVENTION

Hard copy devices process images on media, typically taking the form of printers, plotters (employing inkjet or electron photography imaging technology), scanners, facsimile machines, laminating devices, and various combinations thereof, to name a few. These hard copy devices typically transport media in a sheet form from a supply of cut sheets or a roll to an interaction zone where printing, scanning or post-print processing, such as laminating, overcoating or folding occurs. Often different types of media are supplied from different supply sources, such as those containing plain paper, letterhead, transparencies, pre-printed media, etc.

In some kinds of hard copy apparatus a vacuum apparatus is used to apply a suction or vacuum force to a sheet of flexible media to adhere the sheet to a surface or to stabilize the sheet relative to the surface, for example, for holding a sheet of print media temporarily to a platen. Such vacuum holddown systems are a relatively common, economical technology to implement commercially and can improve machine throughput specifications and the quality of the print job. There are numerous kinds of vacuum platen systems. For example, in ink-jet printers it is known to utilize a rotating drum with holes through the drum surface so that a vacuum through the drum cylinder provides a suction force at the holes in the drum surface. The suction force adheres a sheet of media to the drum surface in order to improve the quality of the print job.

SUMMARY OF THE INVENTION

A vacuum holddown for a hard copy device comprises a platen having an upper surface and plural vacuum zones arranged in a side-by-side array across the platen. Each vacuum zone is coupled to a vacuum source. Each vacuum zone defines a cavity in the upper surface of the platen and each vacuum zone includes a port fluidly coupled to the vacuum source. Each vacuum zone is defined by a back wall and opposed side walls and an open end.

DETAILED DESCRIPTION OF PREFERRED EMBODIMENTS

Figure 1:
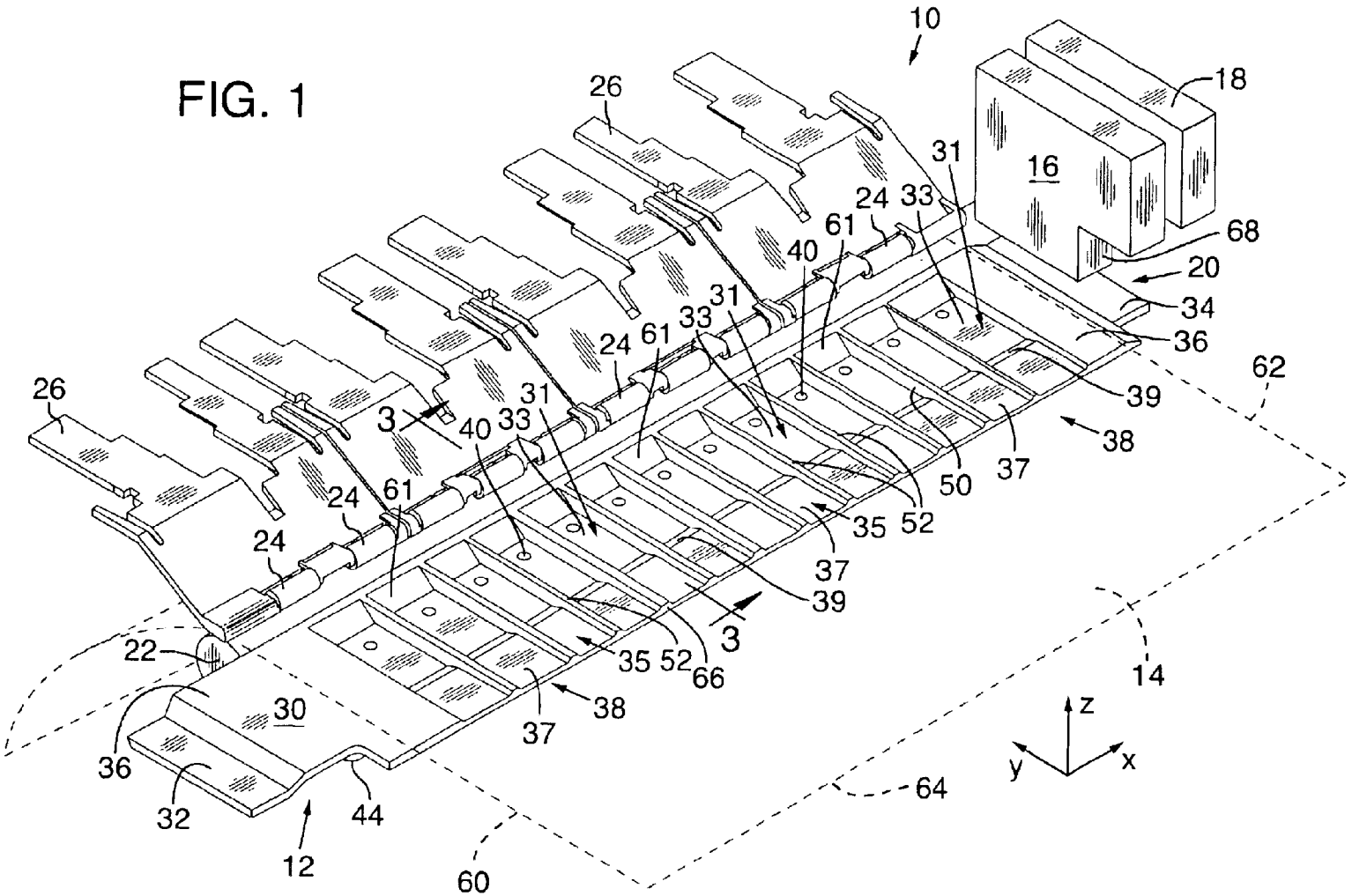
FIG. 1 is a semi-schematic perspective view of selected portions of a hard copy device, here for purposes of illustration an inkjet printer illustrating a vacuum platen according to a first illustrated embodiment of the present invention wherein the platen includes open vacuum zones having a stepped portion.

Some kinds of hard copy apparatus that employ inkjet printing techniques, such as printers, plotters, facsimile machines and the like, utilize a vacuum device either to support print media during transport to and from a printing station (also known as the "print zone" or "printing zone"), to hold the media at the printing station while images or alphanumeric text are formed, or both. The vacuum device applies vacuum force or suction to the underside of the media to hold the media down, away from the pens, to improve print quality. As used herein, the term "vacuum force," is used generally to refer to a suction force applied to media. Other terms may be used interchangeably with vacuum force, such as "vacuum," "negative pressure," or simply "suction." Moreover, for simplicity in description, the term "media" refers generally to all types of print media, including for example individual sheets of paper or paper supplied in a roll form.

The inkjet printing process involves manipulation of drops of ink, or other liquid colorant, ejected from a pen onto an adjacent media. Inkjet pens typically include a printhead, which generally consists of drop generator mechanisms and a number of columns of ink drop firing nozzles. Each column or selected subset of nozzles selectively fires ink droplets, each droplet typically being only a tiny liquid volume, that are used to create a predetermined print matrix of dots on the adjacently positioned paper as the pen is scanned across the media. A given nozzle of the printhead is used to address a given matrix column print position on the paper. Horizontal positions, matrix pixel rows, on the paper are addressed by repeatedly firing a given nozzle at matrix row print positions as the pen is scanned across the paper. Thus, a single sweep scan of the pen across the paper can print a swath of dots. The paper is advanced incrementally relative to the inkjet printheads to permit a series of contiguous swaths.

Stationary, page-wide inkjet printheads or arrays of printheads (known as "page-wide-arrays" or "PWA") are also used to print images on media and the illustrated embodiment of a vacuum platen may be utilized in hard copy devices using PWAs.

A well-known phenomenon of wet-colorant printing is "paper cockle." Simply described, cockle refers to the irregular surface produced in paper by the saturation and drying of ink deposits on the fibrous medium. As a sheet of paper gets saturated with ink, the paper grows and buckles, primarily as a result of physical and chemical interactions between the ink and the paper, and the operating conditions that exist in the printer. Paper printed with images has a greater amount of ink applied to it relative to text pages and is thus more saturated with colorant than simple text pages and exhibits great paper cockle. Colors formed by mixing combinations of other color ink drops form greater localized saturation areas and also exhibit greater cockle tendencies. Cockle can adversely affect the quality of a print job and therefore minimizing and managing the effects of paper cockle are important in maintaining high quality printing.

As inkjet printheads expel minute droplets of ink onto adjacently positioned print media and sophisticated, computerized, dot matrix manipulation is used to render text and form graphic images, the flight trajectory of each drop has an impact on print quality. Several aspects of ink control can be addressed to improve the quality of a print job and to eliminate printing errors. For instance, by controlling the printhead to paper spacing (known as PPS) so that variations in PPS are minimized, randomness in the manner in which ink is deposited can be minimized. Also, it is important that cockle occur away from the pens.

The semi-diagrammatic illustration of FIG. 1 shows pertinent portions of a hard copy device, illustrated for purposes herein as a representative inkjet printer 10 in which an illustrated embodiment of a vacuum platen assembly 12 may be used. For purposes of clarity and to illustrate the invention more clearly, many features of the printer structure and chassis are omitted from the figures. Although the invention is illustrated with respect to its embodiment in one specific type of printer, the invention may be embodied in numerous different types of printers and recorders.

Referring to FIG. 1, inkjet printer 10 includes a vacuum platen assembly identified generally with reference number 12. The vacuum platen assembly is mounted in a chassis (not shown) in an operative position to receive recording media 14, such as individual sheets of paper or paper from one or more sources of media such as paper trays. The vacuum platen assembly 12 is mounted adjacent to one or more media interaction device(s), here inkjet cartridges 16 and 18, which in a printer are supported by and movable on a shaft (not shown) for reciprocating movement past the media along an axis that extends transverse to the media feed axis. The cartridges 16 and 18 are mounted in a carriage assembly, also not shown, which supports the inkjet cartridges above media 14. A media interaction head, in the case of an inkjet printer, a printhead (also not shown) may be attached on the underside of the cartridge. The printhead may be conventional and typically is a planar member having an array of nozzles through which ink droplets are ejected onto the adjacent media. The cartridge is supported on the shaft so that the printhead is precisely maintained at a desired spacing from media 14.

The carriage assembly may be driven in a conventional manner with a servo motor and drive belt, neither of which are shown, but which are under the control of a printer controller. The position of the carriage assembly relative to print media 14 is typically determined by way of an encoder strip that is mounted to the printer chassis and extends laterally across the media, parallel to the shaft on which the inkjet carriage may be mounted. The encoder strip extends past and in close proximity to an encoder or optical sensor carried on the carriage assembly to thereby signal to the printer controller the position of the carriage assembly relative to the encoder strip.

In FIG. 1, the "X" axis is defined as the axis along which inkjet cartridges 16 and 18 reciprocate on the supporting shaft, which as noted is not shown. The "Y" axis is transverse to the X axis, and is the axis of media travel as the media is fed through a media interaction zone 20, which in the case of an inkjet printer is more specifically identified as a printzone where ink is applied to the media. The "Z" axis in FIG. 1 is the axis that extends vertically upward relative to the ground plane.

As noted, many structural features in the printer are omitted from the drawings to clearly illustrate the invention. For example, printer 10 includes numerous other hardware devices and would of course be mounted in a printer housing with numerous other parts included in the complete printer.

For other hard copy devices, such as scanners and facsimile machines and the like, the printer cartridge may be replaced with another type of media interaction head that performs a desired operation on the media in the media interaction zone.

Media 14 is advanced through media interaction zone 20 with a driven linefeed roller 22, which forms a linefeed pinch between the linefeed roller and plural linefeed pinch rollers 24, each of which is mounted on a chassis assembly such as pinch roller guides 26 and which typically would be spring loaded so they are biased against the linefeed roller.

The illustrated embodiment of the invention is a printer that utilizes inkjet printheads to apply ink to the media. With an inkjet printer, the media is incrementally advanced through the printzone in a controlled manner and such that the media advances between swaths of the printheads. A disk encoder and associated servo systems (not shown) are one of the usual methods employed for controlling the precise incremental advance of the media, commonly called "linefeed." Typically, one or more printer controllers synchronize and control linefeed and printhead movement, among other printer operations.

Figure 3:
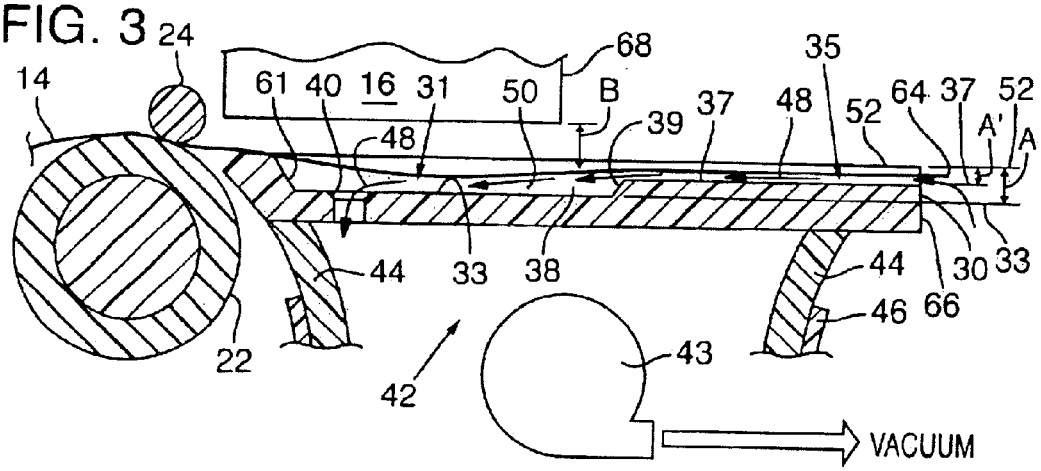
FIG. 3 is a partial cross sectional view taken along the line 3—3 of FIG. 1 and illustrating a sheet of media in the media interaction zone.

The vacuum platen assembly will now be described in detail. Referring to FIG. 1, vacuum platen assembly 12 comprises a platen plate member 30 that extends laterally across the printer along the X axis and is positioned below the inkjets. The platen plate member 30 is positioned relative to the inkjets 16 and 18 such that it supports the media 14 as the media is advanced past the inkjets. The platen plate member 30 thus defines a support for the media in printzone 20. The outer, opposite ends of plate member 30, labeled 32 and 34, respectively, are mounted to and supported by the printer chassis. The upper surface 36 of platen plate member 30—that is, the uppermost surface of the plate member 30 that faces inkjets 16, 18 (see FIG. 3)—provides a surface that defines a portion of printzone 20. A plurality of generally rectangular depressions or vacuum zones 38 is formed in plate member 30, arranged in a side-by-side array extending across the plate member. Each vacuum zone 38 is formed as a cavity or depression in the plate member that is recessed relative to the upper surface 36. In the embodiment of FIG. 1, each vacuum zone 38 is "open" at the "downstream" end of the platen plate member 30, "downstream" referring to the direction along the Y axis along which media 14 advances through the printzone 20. Each of the individual vacuum zones 38 thus is defined by a first chamber 31 and a second chamber 35 that are separated from one another along the Y axis by a step 39 (FIGS. 1 and 3). First chamber 31 has a floor 33 and second chamber 35 has a floor 37, which is stepped upwardly from floor 33 by step 39. Each vacuum zone 38 includes a vacuum passageway or port 40 that extends through a lower surface or floor 31 and through platen plate member 30 into a chamber 42 located beneath plate member 30 (see FIG. 3). Chamber 42 fluidly couples each vacuum zone 38 with a vacuum source, shown here generically as a vacuum fan 43. The number of ports 40, their size and shape, and their distribution pattern in the vacuum zones 38 may vary depending on the design specifics of a particular implementation. In the illustrated embodiment, the ports 40 comprise an essentially linear array of circular apertures.

With reference to FIG. 3, platen plate member 30 includes a downwardly depending frame member 44 that extends completely around the plate member to define the boundary of chamber 42. Frame member 44 is fluidly sealed to a complementary upwardly extending frame member 46 that communicates with vacuum source 43, which as noted may take the form of a vacuum fan, as shown, or a similar blower, pump or the like. It will be appreciated that vacuum source 43 is illustrated generally and is in fluid communication with chamber 42. The vacuum source may be remotely located for convenience of design. The preferred vacuum source is an electrically operated fan that draws air through ports 40, into chamber 42 and through the fan. Frame members 44 and 46 are preferably interconnected such that they form an airtight seal. Rubber gaskets or O-ring seals and the like may be used to facilitate the seal. The general airflow through platen assembly 12 is shown by the arrows 48 in FIG. 3, although it will be appreciated that the actual airflow characteristics are relatively more complex than illustrated by arrows 48.

Referring now to FIGS. 1 and 3, a rib member 50 separates each vacuum zone 38 from the next laterally adjacent vacuum zone 38 and extends upwardly from floor 31 and floor 37. Ribs 50 have an upper surface 52 that is coextensive and coplanar with upper surface 36 of platen plate member 30.

Each vacuum zone 38 is thus a generally rectangular depression formed in platen plate member 30 that defines an opening at the downstream end of the platen plate member, that is, at downstream edge 66 of the plate member 30. A rear wall 61 further defines each vacuum zone, and the opposed side walls of each vacuum zone are defined by ribs 50. With specific reference to FIG. 3, step 39 divides vacuum zones 38 into two vacuum chambers 31 and 35 that have a different depth relative to the distance measured from floors 33 and 35, respectively, to the upper surface 52 of ribs 50. The side walls of each vacuum zone—that is, the walls that extend along the Y axis and thus divide one vacuum zone 38 from the next adjacent vacuum zone or zones 38—are defined by ribs 50, except at the two vacuum zones that are at the outermost lateral ends of the platen, in which case one of the side walls is defined by the wall that defines part of the platen rather than a rib.

The variable depth of vacuum zone 38 defined by step 39 is illustrated schematically in FIG. 3 with the differing heights of the surfaces shown with arrows A and A'. Arrow A represents the depth of vacuum zone 35 measured from floor 33 to the upper surface 52 of rib 50. On the other hand, arrow A' represents the depth of vacuum zone 35 measured from floor 37 to the upper surface 52 of rib 50. The downstream end of vacuum zone 35 is open—that is, floor 37 is recessed below the level of upper surface 52 at downstream edge 66.

Figure 2:
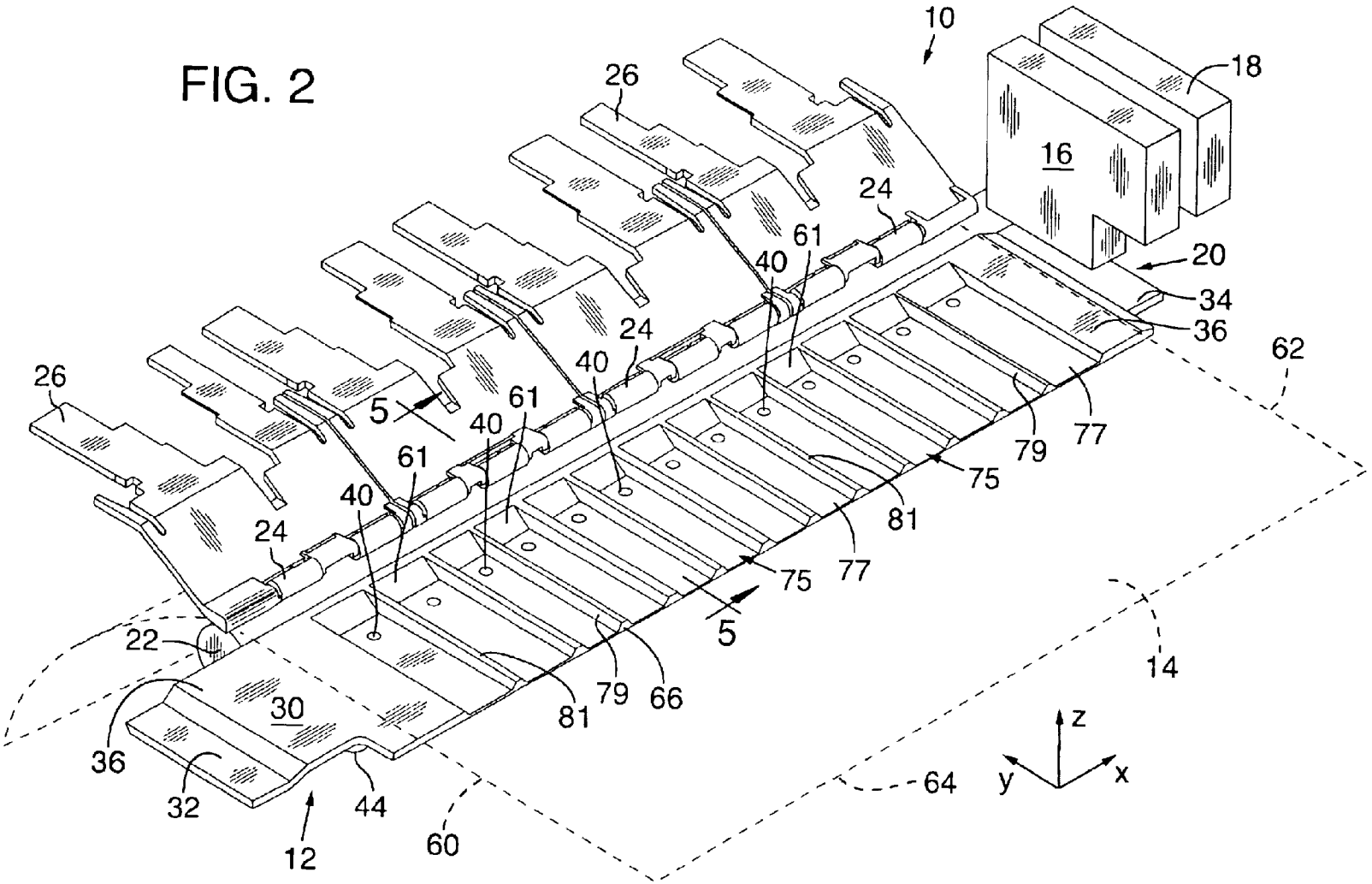
FIG. 2 is a semi-schematic perspective view of selected portions of a hard copy device, again for purposes of illustration an inkjet printer, illustrating a vacuum platen according to a second illustrated embodiment of the present invention wherein the platen includes open vacuum zones that are not stepped.

The embodiment illustrated in FIGS. 2, 5 and 6 will now be described. It will be understood that like reference numerals are used in these figures to identify like structures relative to the embodiment illustrated in FIGS. 1, 3 and 4. With reference to FIG. 2, platen assembly 12 comprises a platen plate member 30 that extends laterally across the printer along the X axis and is positioned below the inkjets. The upper surface 36 of platen plate member 30—that is, the uppermost surface of the plate member 30 that faces inkjets 16, 18—provides a surface that defines a portion of printzone 20.

A plurality of generally rectangular depressions or vacuum zones 75 is formed in plate member 30, arranged in a side-by-side array extending across the plate member. Each vacuum zone 75 is formed as a cavity or depression in the plate member that is recessed relative to the upper surface 36. Each vacuum zone 75 is open at the downstream end of the platen plate member 30—that is, at downstream edge 66 of the plate member. Each of the individual vacuum zones 75 has a floor 77 that extends completely to the downstream edge 66 of plate member 30. Each vacuum zone 75 includes a vacuum passageway or port 40 that extends through a lower surface or floor 77 and through platen plate member 30 into a chamber 42 located beneath plate member 30 (see FIG. 5). The number of ports 40, their size and shape, and their distribution pattern in the vacuum zones 38 may vary depending on the design specifics of a particular implementation. In the illustrated embodiment, the ports 40 comprise an essentially linear array of circular apertures. It will be appreciated that the structures located below the plate member 30 shown in FIGS. 2, 5 and 6 are identical to the structures described above with reference to FIGS. 1, 3 and 4. As such, a description of those structures is omitted here.

A rib member 79 separates each vacuum zone 75 from the next adjacent vacuum zone 75 and extends upwardly from floor 77. With reference to FIG. 2, ribs 79 have an upper surface 81 that is coextensive and coplanar with upper surface 36 of platen plate member 30.

Each vacuum zone 75 is thus a generally rectangular depression formed in platen plate member 30 that defines an opening at the downstream end of the platen plate member, that is, at downstream edge 66 of the plate member 30. A rear wall 61 further defines each vacuum zone, and ribs 50 define the opposed side walls of each vacuum zone. With specific reference to FIG. 5 vacuum zone 75 is open at downstream edge 66 of plate member 30 and is a constant depth along its entire length. Stated otherwise, floor 77 is recessed below upper surface 81 of ribs 79 and coplanar with the upper surface 81.

The operation of the open vacuum zones described above in the embodiments of FIGS. 1 and 2 will now be described with reference to a sheet of media 14 as it advances through the printzone.

Beginning with the open vacuum zone embodiment of FIG. 1, media 14 is shown as being a standard sized cut sheet such as an 8½×11 inch sheet of paper. The outer lateral edges of media 14, here labeled 60 and 62, respectively, extend laterally across platen plate member 30 beyond the outermost vacuum zones 38 such that the outer edges of the paper rest on upper surface 36. It will be appreciated that the printer is designed to accommodate several different kinds of media that have several different widths. The media 14 shown in FIG. 1 is one of many kinds of media that may be used with the illustrated embodiment of a vacuum platen and is shown for illustrative purposes only. The outer edge 62 of the media, regardless of the size of media being used, will usually be aligned on the platen in the position shown in FIG. 1. The spacing between adjacent ribs 50 is typically adjusted so that the opposite outer edge 60 of the media, regardless of the width of the particular media in question, rests on or near a rib.

The vacuum source 43 is either activated as the leading edge 64 of media 14 is advanced by linefeed roller 22 through printzone 20 or is activated prior to the leading edge entering the printzone to induce a flow of air from the upper surface of the platen into the vacuum zones 38 and through ports 40 into chamber 42. As noted, the flow of air is shown generally with arrows 48 in FIG. 3, but again the airflow is typically more complex than may be implied with the arrows.

FIG. 3 illustrates the flow of air through the vacuum platen assembly 12 when media is present but where no ink-induced cockle is occurring in the media. In FIG. 3, the leading edge 64 of media 14 has advanced past the forward edge 66 of platen plate member 30. Airflow, again represented by arrows 48, is directed under the lower surface of media 14, between the lower surface of the media and floor 37 of vacuum zone 35, over step 39 and into vacuum zone 31, then through port 40 into chamber 42. The vacuum force applied thereby causes the media to be deflected downwardly slightly toward the platen, away from the inkjet 16. Application of vacuum force in this manner tends to hold media 14 in a relatively flat orientation on platen plate member 30 and therefore controls the printhead to paper spacing so that the distance B in FIG. 3 is relatively constant. When the PPS is controlled, randomness in the manner in which ink droplets are deposited on the media is minimized.

In a fluid flow system such as that illustrated in FIG. 3, major losses that occur between the downstream edge 66 and step 39 are greater than those that occur between step 39 and port 40. Stated another way, the air pressure decreases in the direction of the airflow (arrows 48) due to major losses. Conversely, vacuum levels increase in the direction of the airflow. There will, therefore, be relatively lower pressure in vacuum zone 31 (greater vacuum) compared to the pressure in vacuum zone 35. Thus, by forming the vacuum zone 38 in such a manner as illustrated in FIGS. 1 and 3, where vacuum zone 31 is relatively deeper than the adjacent vacuum zone 35, a more consistent vacuum level may be applied to media 14 in the printzone 20 under the inkjets. By positioning step 39 so that it is spaced in the downstream direction from the downstream edge 68 of the inkjets 16, 18, the lower pressure vacuum zone 31 encompasses the entire printzone. This ensures that cockle growth is controlled in a desired manner—that is, in the direction away from the inkjets across the entire printzone.

Figure 4:
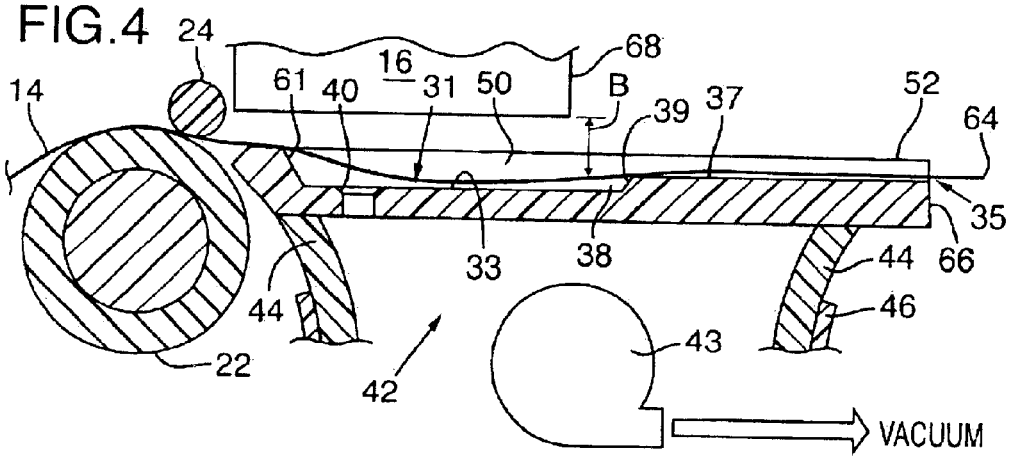
FIG. 4 is a partial cross sectional view as in FIG. 3, and illustrating a sheet of media in the media interaction zone after ink has been applied to the media and the media is exhibiting cockle.

FIG. 4 illustrates a sheet of media 14 onto which ink has been applied. The media 14 is exhibiting cockle as a result of the interactions between the ink and the media. Airflow in FIG. 4 normally is directed under the lower surface of media 14, between the lower surface of the media and upper surface 36 of the platen, into and through the adjacent vacuum zones 35 and 31, and through port 40 into chamber 42. As cockle is formed in media 14, the vacuum force applied to the media causes the paper to be deflected downwardly toward the platen to a greater extent than shown in FIG. 3. That is, cockle growth occurs in the direction away from the inkjet printheads. Although the cockle results necessarily in slight variations in PPS (distance B) at some points in printzone 20, the application of vacuum over the entire printzone insures that cockle growth is away from the inkjet 16.

In some instances, for example where a substantial amount of ink is applied to the media, cockle growth can be significant and may extend to the point where a temporary constriction is formed between media 14 and floor 37 at step 39. Even if this occurs with the embodiment illustrated in FIGS. 1, 3 and 4, vacuum will be present in vacuum zone 31 because step 39 is located downstream of the downstream edge 68 of the inkjets. As a result, even where substantial cockle growth has temporarily altered the airflow dynamics, vacuum will be applied to the underside of the media so cockle growth occurs in the direction away from the inkjets.

Figure 5:
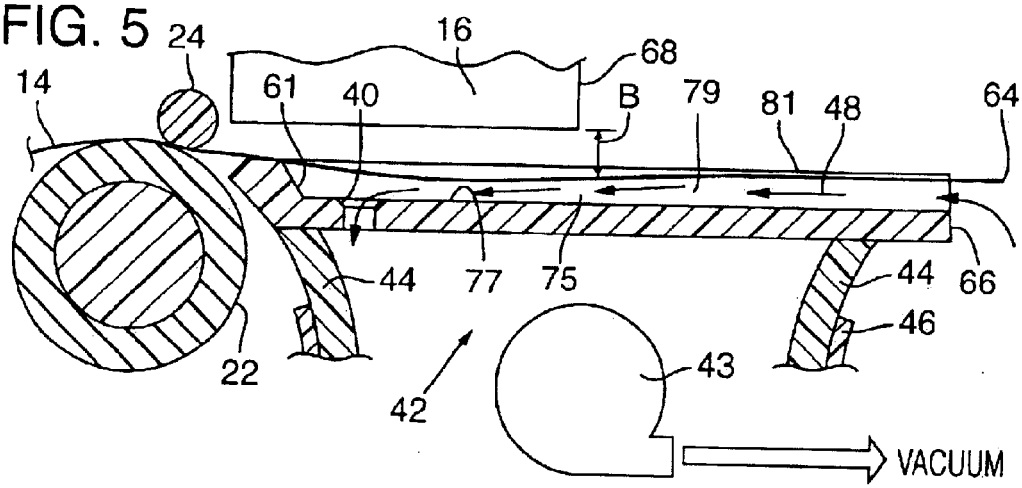
FIG. 5 is a partial cross sectional view taken along the line 5—5 of FIG. 2 and illustrating a sheet of media in the media interaction zone.
Figure 6:
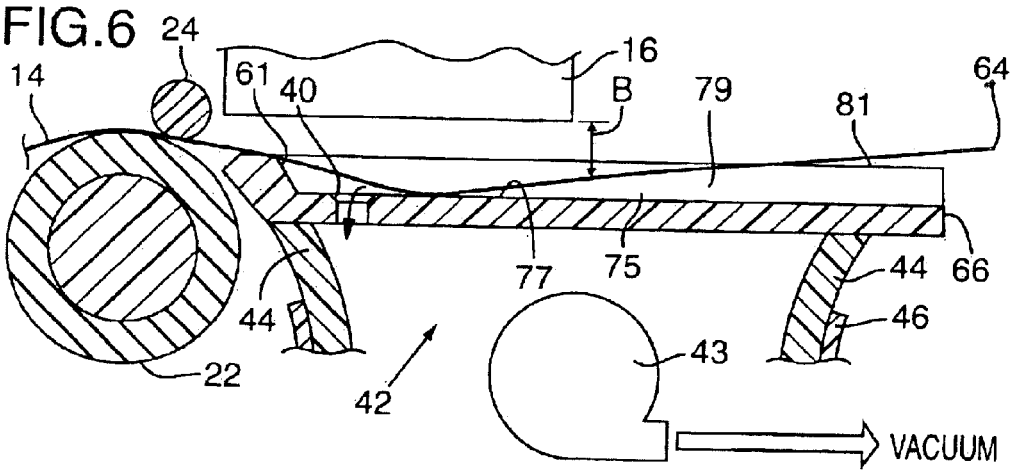
FIG. 6 is a partial cross sectional view as in FIG. 5 and illustrating a sheet of media in the media interaction zone after ink has been applied to the media and the media is exhibiting cockle

The operation of the open vacuum zone platen illustrated in FIGS. 2, 5 and 6 are similar to those described above with respect to the embodiment of FIG. 1. Turning to FIG. 2, the outer lateral edges 60 and 62 of media 14 extend laterally across platen plate member 30 beyond the outermost vacuum zones 38 such that the outer edges of the paper rest on upper surface 36. The vacuum source 43 is either activated as the leading edge 64 of media 14 is advanced by linefeed roller 22 through printzone 20 or is activated prior to the leading edge entering the printzone to induce a flow of air from the upper surface of the platen into the vacuum zones 75 and through ports 40 into chamber 42, arrows 48.

FIG. 5 illustrates the flow of air through the vacuum platen assembly 12 when media is present but where no ink-induced cockle is occurring in the media. In FIG. 5, the leading edge 64 of media 14 has advanced past the forward edge 66 of platen plate member 30. Airflow, again represented by arrows 48, is directed in vacuum zones 75 under the lower surface of media 14, between the lower surface of the media and floor 77, then through port 40 into chamber 42. The vacuum force applied thereby causes the media to be deflected downwardly slightly toward the platen, away from the inkjet 16, and holding media 14 in a relatively flat orientation on platen plate member 30.

FIG. 6 illustrates a sheet of media 14 onto which ink has been applied. The media 14 is exhibiting cockle as a result of the interactions between the ink and the media. Airflow in FIG. 6 is directed under the lower surface of media 14, between the lower surface of the media and upper surface 36 of the platen, into and through the vacuum zone75, and through port 40 into chamber 42. As cockle is formed in media 14, the vacuum force applied to the media causes the paper to be deflected downwardly toward the platen. That is, cockle growth occurs in the direction away from the inkjet printheads. Although the cockle results necessarily in slight variations in PPS (distance B) at some points in printzone 20, the application of vacuum over the entire printzone insures that cockle growth is away from the inkjet 16.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A method of controlling media cockle, the method comprising:

(a) providing a printzone between an inkjet and a platen, the printzone having an upstream end and a downstream end relative to a direction of media advancement through the printzone, and wherein the platen has an upper surface spaced from the inkjet and plural vacuum zones arranged side-by-side across the platen, each vacuum zone defining a recess in the platen having a closed end at the upstream end of the platen and an open end at the downstream end of the platen, and wherein each vacuum zone further defines a first floor level at the upstream end and a second floor level at the downstream end, the distance from the first floor level to the platen upper surface is greater than the distance from the second floor level to the platen upper surface;

(b) advancing media through the printzone;

(c) applying ink to the media; and (d) applying suction to the surface of the media facing the platen to draw the media away from the inkjet.

2. The method of claim 1 wherein the step of applying suction to the surface of the media includes the step of inducing a flow of air through the open end of each vacuum zone and through a port in each vacuum zone at the upstream end.

3. A holddown for hard copy device, comprising:

means for interacting with media in a media interaction zone;

means for advancing media through said media interaction zone;

platen means for supporting said media in said media interaction zone, said platen means having an upper surface including a plurality of vacuum zones in an array extending across said upper surface, each vacuum zone defining a recess in the platen having a closed end at the upstream end of the platen and an open end at the downstream end of the platen, and wherein each vacuum zone further defines a first floor at the upstream end and a second floor at the downstream end, wherein the distance from the first floor to the platen upper surface is greater than the distance from the second floor to the platen upper surface; and vacuum means fluidly coupled to said ports for applying vacuum to said media.

4. The holddown according to claim 3 wherein the platen means further comprises each vacuum zone having a back wall and opposed side walls wherein the back wall and opposed side walls having upper surfaces coplanar with the upper surface of said platen.

5. The holddown according to claim 3 wherein the first floor is planar.

6. The holddown according to claim 5 wherein the second floor is planar.

7. The holddown according to claim 6 wherein each vacuum zone comprises a step between the first floor and the second floor.

8. The holddown according to claim 7 wherein the vacuum means is configured for inducing airflow from said open ends, into said vacuum zones and through said ports.

9. A vacuum holddown for a hard copy apparatus, comprising:

a platen having an upper surface and an upstream end and a downstream end relative to a direction of media travel;

an inkjet operatively positioned relative to the platen and spaced apart from the upper surface, the inkjet and the platen defining a printzone therebetween;

multiple vacuum zones in the platen, each vacuum zone comprising a recess in the upper surface opening to the downstream end, wherein each recess defines a first floor portion toward the upstream end and a second floor portion toward the downstream end, the first and second floor portions having a step therebetween, wherein the distance from the first floor portion to the platen upper surface is greater than the distance from the second floor portion to the platen upper surface;

a port in each vacuum zone;

a vacuum source fluidly communicating with each port.

10. The vacuum holddown according to claim 9 wherein the platen further comprises said vacuum zones arranged in a side-by-side array and wherein each of said vacuum zones is further defined by a back wall and opposed side walls having upper surfaces that are coplanar with the platen upper surface.

11. The vacuum holddown according to claim 10 wherein the first floor portion and the second floor portion are planar.

12. The holddown according to claim 11 including a step between the first floor portion and the second floor portion.

13. A vacuum holddown for a hard copy apparatus, comprising:

a platen having an upper surface and an upstream end relative to a direction of media travel and a downstream end;

an inkjet operatively positioned relative to the platen and spaced apart from the upper surface, the inkjet and the platen defining a printzone therebetween;

multiple vacuum zones arranged in a side by side array in the platen, each vacuum zone comprising a rectangular recess in the upper surface having a planar floor bordered by a back wall, and opposed side walls extending linearly to the open end, the back wall and side walls having upper surfaces coplanar with the platen upper surface;

a port in each vacuum zone and a vacuum source communicating with each port, wherein said port is positioned in each vacuum zone such that a level of vacuum force increases within each vacuum zone from a downstream end of each vacuum zone to an upstream end of each vacuum zone.

14. A method of controlling ink-induced cockle in printed media, the method comprising:

(a) advancing media through a printzone between an inkjet and a platen, the media advancing through the print zone from an upstream end toward a downstream end;

(b) applying ink to the media in the printzone;

(c) inducing a vacuum to draw the media away from the inkjet by creating a flow of air between the media and the platen, wherein the platen has an upper surface and plural vacuum zones arranged in a side-by-side array, each vacuum zone defining a recess in the platen having a closed end and open end and the air flows from the open end toward the closed end, and wherein each vacuum zone further defines a first floor level at the upstream end and a second floor level at the downstream end, and wherein the vacuum applied to the media at the upstream end is greater than the vacuum applied to the media at the downstream end.

15. The method of claim 14 wherein the step of applying greater vacuum to the media at the upstream end than the downstream end includes the step of causing air to flow over a step in each vacuum zone between the first floor level and the second floor level, wherein the distance from the first floor level to the platen upper surface is greater than the distance from the second floor level to the platen upper surface.

16. The method of claim 15 wherein the step of applying ink to the media occurs only upstream of the step.

17. A method of controlling ink-induced cockle in printed media, the method comprising:

(a) advancing media through a printzone between an inkjet and a platen, the media advancing through the printzone from an upstream end toward a downstream end;

(b) applying ink to the media in the printzone;

(c) inducing vacuum in a plurality of vacuum zones in the platen, wherein in each vacuum zone the level of vacuum force increases in the direction from the downstream end to the upstream end.

18. The method of claim 17 wherein the vacuum zones are arranged in a side-by-side array and each vacuum zone defines a rectangular recess having a closed end and open end and a step therebetween, and wherein ink is applied to the media only upstream of the step.

19. The method of claim 18 wherein inducing a vacuum includes causing air to flow from the downstream end of each vacuum zone over the step toward the upstream end, and wherein the level of vacuum upstream of the step is greater than the level of vacuum applied to the media downstream of the step.

20. The method of claim 19 wherein the vacuum causes the media stabilizes the media on the platen.

* * * * *